US010015599B2

(12) United States Patent
Fan et al.

(10) Patent No.: US 10,015,599 B2
(45) Date of Patent: Jul. 3, 2018

(54) MICRO SPEAKER

(71) Applicant: GOERTEK INC., WeiFang, Shandong (CN)

(72) Inventors: Shuangshuang Fan, WeiFang (CN); Gang Chen, WeiFang (CN); Yun Yang, WeiFang (CN); Xinxiang Huo, WeiFang (CN); Dan Han, WeiFang (CN)

(73) Assignee: GOERTEK INC., WeiFang, Shandong (CN)

( * ) Notice: Subject to any disclaimer, the term of this patent is extended or adjusted under 35 U.S.C. 154(b) by 0 days.

(21) Appl. No.: 15/537,317

(22) PCT Filed: Nov. 4, 2015

(86) PCT No.: PCT/CN2015/093769

§ 371 (c)(1),
(2) Date: Jun. 16, 2017

(87) PCT Pub. No.: WO2016/095618

PCT Pub. Date: Jun. 23, 2016

(65) Prior Publication Data

US 2017/0332175 A1 Nov. 16, 2017

(30) Foreign Application Priority Data

Dec. 16, 2014 (CN) ..... 2014 1 0782037

(51) Int. Cl.
*H04R 9/06* (2006.01)
*H04R 9/02* (2006.01)
(Continued)

(52) U.S. Cl.
CPC ..... *H04R 9/06* (2013.01); *H04R 7/127* (2013.01); *H04R 7/18* (2013.01); *H04R 9/025* (2013.01); *H04R 9/046* (2013.01)

(58) Field of Classification Search
CPC ..... H04R 7/18; H04R 7/127; H04R 9/025; H04R 9/06
See application file for complete search history.

(56) References Cited

U.S. PATENT DOCUMENTS 7,447,328 B2 * 11/2008 Takewa ..... H04R 9/04 381/150
9,357,311 B2 * 5/2016 Xu ..... H04R 9/025
(Continued)

FOREIGN PATENT DOCUMENTS

CN 102595284 A 7/2012
CN 202551337 U 11/2012
(Continued)

OTHER PUBLICATIONS

International Search Report dated Jan. 20, 2016 of PCT/CN2015/093769 which is the parent application and its English translation—4 pages.

*Primary Examiner* — Brian Ensey
(74) *Attorney, Agent, or Firm* — Knobbe Martens Olson & Bear LLP

(57) ABSTRACT

Disclosed is a micro speaker, comprising a vibration system, a magnetic circuit system and a support system; the vibration system comprises a vibrating diaphragm; a dodging groove is provided on a dome portion of the vibrating diaphragm opposite to a groove structure of an upper housing; the depth of the dodging groove is not less than that of the groove structure; an orthographic projection area of the dodging groove covers that of the groove structure; a dodging structure is provided on a washer of the magnetic circuit system opposite to the dodging groove; the depth of the dodging structure is not less than that of the dodging groove; and the orthographic projection area of the dodging structure covers that of the dodging groove. This structure
(Continued)

ensures the normal operation of a product and acoustic performance of a micro speaker while preventing collision of components.

10 Claims, 3 Drawing Sheets

(51) Int. Cl.

| | |
|---|---|
| ***H04R 7/18*** | (2006.01) |
| ***H04R 7/12*** | (2006.01) |
| ***H04R 9/04*** | (2006.01) |

(56) References Cited

U.S. PATENT DOCUMENTS

| | | | | |
|---|---|---|---|---|
| 2011/0115337 | A1 | 5/2011 | Nakamura et al. | |
| 2014/0294228 | A1* | 10/2014 | Itano ..... | H04R 9/025<br>381/414 |

FOREIGN PATENT DOCUMENTS

| | | | |
|---|---|---|---|
| CN | 203691623 | U | 7/2014 |
| CN | 104540078 | A | 4/2015 |

* cited by examiner

MICRO SPEAKER

TECHNICAL FIELD

The present invention relates to the technical field of electro-acoustic products, and more particularly, to a micro speaker.

BACKGROUND ART

The micro speaker in the prior art typically comprises a vibration system, a magnetic circuit system and a support system for accommodating and fixing the vibration system and the magnetic circuit system, wherein the vibration system typically comprises a vibrating diaphragm and a voice coil, the magnetic circuit system comprises a washer, a magnet and a magnetic yoke that are sequentially combined together, and the magnetic circuit system forms a magnetic gap for accommodating the voice coil. The upper housing in the support system generally has a flat plate-shaped structure, and a sound hole for sound to pass through is provided on the upper housing. The conventional upper housing generally has a flat plate-shaped structure, and accordingly, a flat plate-shaped or hollow structure is provided at the position on the upper housing opposite to the vibrating diaphragm.

Typically, the micro speaker is required to be used in conjunction with the terminal electronic device, and accordingly, the structure of the support system of the micro speaker is required to be matched with the terminal. However, for an upper housing in the support system provided with a groove structure, the vibration system and the magnetic circuit system cannot be assembled according to the conventional structure. The conventional vibrating diaphragm basically has a planar structure. If the upper housing is provided with a groove structure which is recessed towards the vibrating diaphragm, the vibrating diaphragm is required to be spaced apart from the upper housing by a certain distance to prevent the collision of the vibrating diaphragm with the upper housing during vibrating of the vibrating diaphragm. However, with such a structure, the size of the vibration system and the magnetic circuit system would be reduced, and the acoustic performance of the product would be affected. Accordingly, the present patent provides an improved solution that enables the vibration system and the magnetic circuit system to be better adapted to the above upper housing structure.

SUMMARY

The technical problem to be solved by the present invention is to provide a micro speaker in which the vibration system and the magnetic circuit system of the micro speaker can be adapted to the upper housing in the case that the upper housing has a recess, so as to ensure the acoustic performance of the product.

In order to solve the above technical problem, the technical solution of the present invention is a micro speaker comprising a vibration system, a magnetic circuit system and a support system for accommodating and fixing the vibration system and the magnetic circuit system. The vibration system comprises a vibrating diaphragm and a voice coil bonded to one side of the vibrating diaphragm, and the vibrating diaphragm comprises a rigid dome portion located at a central position and a suspension ring portion located at an edge position. The magnetic circuit system comprises a washer, a magnet and a magnetic yoke which are sequentially combined together, and a magnetic gap for accommodating the voice coil is formed in the magnetic circuit system. The support system comprises an upper housing. The upper housing is provided with a recessed groove structure at a position corresponding to the center dome portion of the vibrating diaphragm. Wherein, the dome portion is provided with a dodging groove at a position opposite to the groove structure of the upper housing; a vertical depth of the dodging groove is not less than a depth of the groove structure of the upper housing; an orthographic projection area of the dodging groove covers an orthographic projection area of the groove structure of the upper housing; the washer is provided with a dodging structure opposite to the dodging groove of the vibrating diaphragm; a vertical depth of the dodging structure is not less than the depth of the dodging groove; and an orthographic projection area of the dodging structure covers the orthographic projection area of the dodging groove of the vibrating diaphragm.

In addition, it is preferable that a thickness of the washer is not less than the vertical depth of the dodging groove of the vibrating diaphragm. The washer opposite to the vibrating diaphragm is a hollow annular structure, and the dodging structure of the washer is a hollow portion of the washer, an orthographic projection area of the hollow portion of the washer overlaps with the orthographic projection area of the dodging groove of the vibrating diaphragm.

In addition, it is preferable that the magnetic circuit system is a dual magnetic circuit structure that comprises a center washer and a center magnet which are bonded to a central position of the magnetic yoke, and an edge washer and an edge magnet which are bonded to an edge position of the magnetic yoke; wherein the center washer is provided at a position opposite to the dome portion of the vibrating diaphragm.

In addition, it is preferable that a thickness of the center washer is not less than the vertical depth of the dodging groove of the vibrating diaphragm. The center washer is a hollow annular structure, and a hollow portion of the center washer is provided at a position opposite to the dodging groove of the vibrating diaphragm, an orthographic projection area of the hollow portion of the washer overlaps with the orthographic projection area of the dodging groove of the vibrating diaphragm.

In addition, it is preferable that the center washer is a hollow annular structure, the center magnet is also a hollow annular structure, and an orthographic projection area of a hollow portion of the center magnet overlaps with the orthographic projection area of the hollow portion of the center washer.

In addition, it is preferable that the vertical depth of the dodging groove of the vibrating diaphragm is equal to the vertical depth of the groove structure of the upper housing.

In addition, it is preferable that each of the groove structure of the upper housing and the dodging groove of the vibrating diaphragm is provided with a transition slope, and the transition slope of the groove structure is parallel to the transition slope of the dodging groove.

In addition, it is preferable that each of the dodging groove of the vibrating diaphragm and an inner edge of the center washer is provided with a transition slope, and the transition slope of the dodging groove is parallel to the transition slope of the inner edge of the center washer.

In addition, it is preferable that the support system further comprises a middle housing and a lower housing, and the middle housing and the lower housing support and fix the magnetic circuit system.

In addition, it is preferable that the upper housing comprises a plastic holder and a steel sheet which is coupled with the plastic holder through injection molding.

By adopting the above technical solution, compared with conventional structures, the vibrating diaphragm and the magnetic circuit system of the present invention are provided with dodging structures matched with the front cover. The structures matched with the upper housing can prevent collision of components, while ensure the normal operation of the product and the acoustic performance of the micro speaker.

BRIEF DESCRIPTION OF THE DRAWINGS

The above features and technical advantages of the present disclosure will become more clear and easy to understand through the descriptions of the present disclosure in connection with the accompanying drawings below.

DETAILED DESCRIPTION OF EMBODIMENTS

Hereinafter, the present invention is described in detail in connection with the accompanying drawings and particular embodiments.

Figure 1:
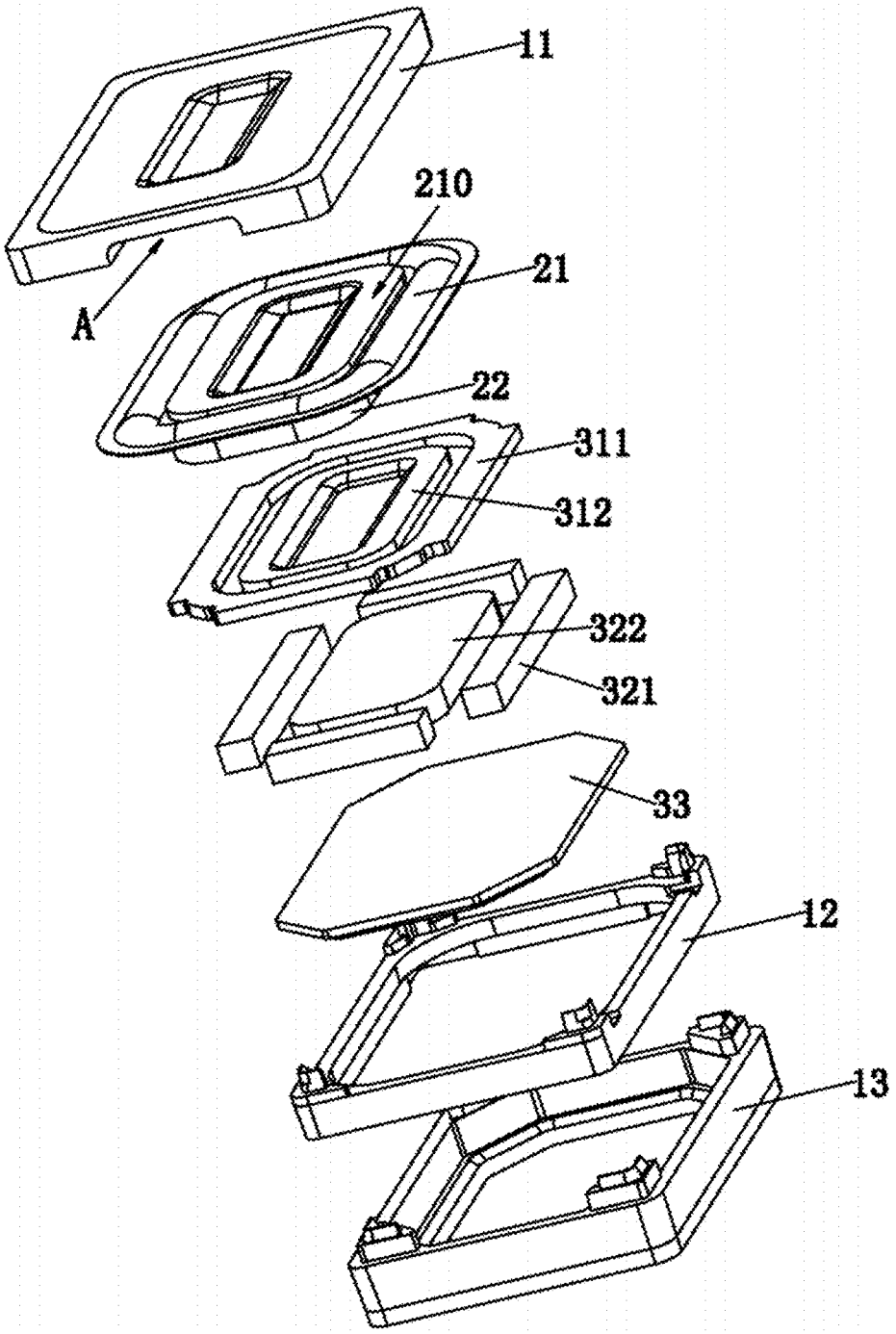
FIG. 1 is an exploded view of a micro speaker according to the first embodiment of the present invention.
Figure 2:
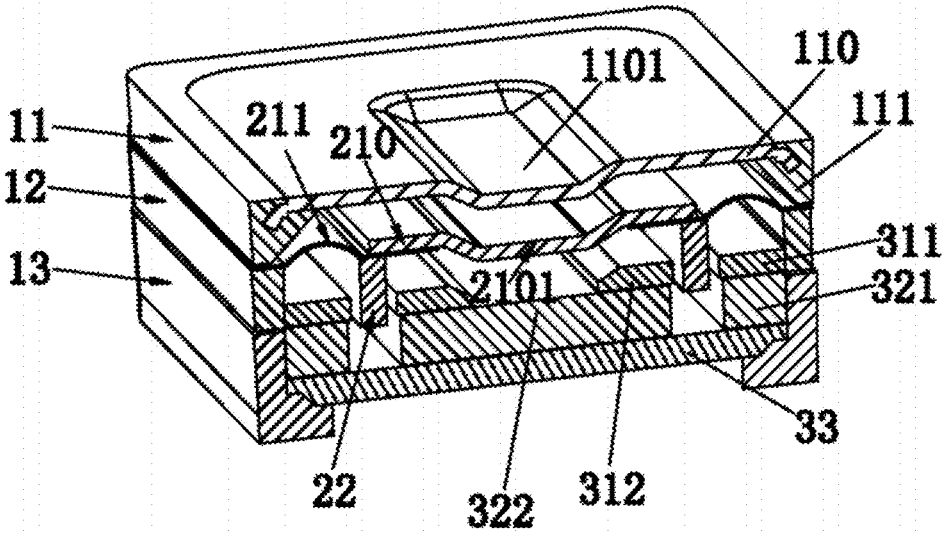
FIG. 2 is a cross sectional view of the micro speaker according to the first embodiment of the present invention.

First Embodiment:

As shown in FIG. 1 and FIG. 2, the micro speaker comprises a vibration system, a magnetic circuit system and a support system, wherein the support system accommodates and fixes the vibration system and the magnetic circuit system. The vibration system comprises a vibrating diaphragm 21 and a voice coil 22 bonded to one side of the vibrating diaphragm 21, the vibrating diaphragm 21 comprises a dome portion 210 located at the central position and a suspension ring portion 211 located at the edge position. The dome portion 210 in the present embodiment is a rigid composite layer which is hard and light to prevent split vibration in high frequency. The suspension ring portion 211 of the vibrating diaphragm 21 is made from a flexible material, for example, typically a composite formed by multiple layers of resin material and adhesive layers, so as to follow the upward and downward vibrations of the vibrating diaphragm 21. The rigid dome portion 210 and the flexible suspension ring portion 211 are bonded and fixed by an adhesive layer. The magnetic circuit system comprises a washer, a magnet and a magnetic yoke that are sequentially combined together. The magnet is a permanent magnet, and the washer and magnetic yoke are used for correcting the magnetic lines generated by the magnet. The voice coil 22 is placed in the magnetic field formed by the magnetic circuit system. The magnetic circuit system in the present embodiment is a dual magnetic circuit structure and comprises a center washer 312 and a center magnet 322 which are sequentially bonded to the central position of the magnetic yoke 33, and an edge washer 311 and an edge magnet 321 which are sequentially bonded to the edge position of the magnetic yoke 33, wherein, a magnetic gap for accommodating the voice coil 22 is formed between the center magnet 322 along with the center washer 312 and the edge washer 311 along with the edge magnet 321, and the magnetic circuit system forms a stable magnetic field in the magnetic gap. The voice coil 22 vibrates up and down in the magnetic field under Ampere force after supplied with electric signals, and further vibrates the vibrating diaphragm 21 to generate sound.

The support system comprises an upper housing 11, a middle housing 12 and a lower housing 13 which are sequentially combined, and the support system accommodates the fixes the vibration system and the magnetic circuit system, and plays a protective role for the micro speaker. The upper housing 11 of the conventional micro speaker is a flat plate-shaped structure, but the central position of the upper housing 11 of the present invention is provided with a groove structure in order to be assembled with a specific terminal electronic device. With such a change, the micro speaker is adapted to a terminal electronic device with a specific structure. The groove structure of the upper housing 11 of the present application is recessed toward the side closer to the vibrating diaphragm 21, and the dome portion at the center of the conventional vibrating diaphragm is typically a flat plate-shaped structure. However, if the dome portion of the vibrating diaphragm is a flat plate-shaped structure in the present application, it is easy to contact with the bottom surface of the groove structure of the upper housing 11 and generate noise. If the distance between the flat plate-shaped vibrating diaphragm and the upper housing 11 is increased, the possibility of collision may be reduced, however, the size of the magnetic circuit system and the vibration system would be reduced correspondingly, and thus the acoustic performance of the product will be affected.

Therefore, in the present invention, in order to cope with the design of the upper housing 11 having the groove structure 1101, a dodging groove 2101 is provided on the dome portion 210 opposite to the groove structure 1101 of the upper housing 11. The vertical depth of the dodging groove 2101 is not less than the vertical depth of the groove structure 1101, and the orthographic projection area of the dodging structure 2101 can completely cover the orthographic projection area of the groove structure 1101 to prevent the upper housing 11 and the vibrating diaphragm 21 from colliding when the vibrating diaphragm 21 vibrates. Preferably, the groove structure 1101 of the upper housing 11 is exactly the same as the dodging groove 2101 on the dome portion 210 in shape, as shown in FIG. 2, the cross-sectional shape, size and dimension of the groove structure 1101 are the same as those of the dodging groove 2101, and the projection of the groove structure 1101 in the vertical direction completely overlaps with the projection of the dodging groove 2101 in the vertical direction. Both the groove structure 1101 of the upper housing 11 and the dodging groove 2101 of the vibrating diaphragm 21 are provided with transition slopes, as shown in FIG. 2, the transition slope of the groove structure 1101 is parallel to the transition slope of the dodging groove 2101. In addition, the orthographic projection area of the dodging groove 2101 of the dome portion 210 may be larger than the orthographic projection area of the groove structure 1101 of the upper housing 11, and this structure is also within the scope of the present invention.

The depth of the groove structure 1101 of the upper housing 11 is the same as the depth of the dodging groove 2101 of the vibrating diaphragm 21. Assuming the distance between the flat plate portion of the upper housing 11 and the flat portion of the dome portion 210 is d, preferably, the distance between the bottom of the groove structure 1101 of the upper housing 11 and the bottom of the dodging groove 2101 of the dome portion 210 is d as well, that is, the two distances are the same. This design may avoid the collision of the bottom of the groove structure 1101 of the upper housing 11 with the vibrating diaphragm 21 to ensure the sound effect of the vibrating diaphragm 21.

With the dome portion 210 provided with the dodging groove 2101, since the orthographic projection area of the dome portion 210 is not changed, the effective vibration area of the vibrating diaphragm 21 is not changed. Thus, the acoustic performance of the vibrating diaphragm 21 is not affected by the arrangement of the dodging groove 2101. Therefore, the improved structure with the vibrating diaphragm 21 matched with the upper housing 11 in the present invention does not reduce the sizes of the vibration system and the magnetic circuit system and not affect the acoustic performance of the product, and thus the acoustic performance of the product is also ensured while the micro speaker is adapted to the terminal electronic device.

As jointly shown in FIG. 1 and FIG. 2, since the dome portion 210 of the vibrating diaphragm 21 has the dodging groove 2101, if the washer opposite to the vibrating diaphragm 21 is in the form of a flat plate, the vibrating diaphragm 21 will collide with the washer when it vibrates downward. As an improvement, a dodging structure is provided on the washer opposite to the dodging groove 2101 of the dome portion 210. In the present embodiment, the structure opposite to the dodging groove 2101 of the dome portion 210 is the center washer 312. Preferably, the dodging structure of the center washer 312 is groove-shaped, and the vertical depth of the dodging structure of the center washer 312 is not less than the vertical depth of the dodging groove 2101 of the dome portion 210. Besides, the orthographic projection area of the dodging structure of the center washer 312 can completely cover the orthographic projection area of the dodging groove 2101 of the dome portion 210 to prevent the vibrating diaphragm 21 from colliding with the center washer 312.

The thickness of center washer 312 in the present embodiment is not less than the vertical depth of the dodging groove 2101, in order to fit the groove structure 1101 of the upper housing 11 and the dodging groove 2101 of the dome portion 210, as an improvement, the dodging structure of the center washer 312 in the present invention is a structure in which the entire center portion of the center washer 312 is removed, so that the center washer 312 is a hollow annular structure so as to meet the requirements of the dodging structure of the center washer 312 in the present invention. The center washer 312 is a magnetically permeable structure that can be used for correcting the magnetic lines generated by the center magnet 322. As the main working area of the center washer 312 is located at the edge position, the hollow annular center washer 312 in the present patent does not adversely affect the magnetic circuit system. Preferably, the orthographic projection area of the hollow portion of the center washer 312 overlaps with the orthographic projection area of the dodging groove 2101 of the dome portion 210 to ensure the volume of the center washer 312, and ensure the operational requirement of the center washer 312 on correcting the magnetic lines of the center magnet 322 to the largest extent while the vibrating diaphragm 21 does not collide with the center washer 312.

Both the dodging groove 2101 of the vibrating diaphragm 21 and the inner edge of the center washer 312 are provided with transition slopes, and the transition slope of the dodging groove 2101 is parallel to the transition slope of the inner edge of the center washer 312. The arrangement of the transition slopes facilitates the circulation of air.

In view of the above, with the design of providing corresponding dodging structures on the vibrating diaphragm 21 and the center washer 312 at the positions opposite to the groove structure 1101 of the upper housing 11, respectively, the normal operation of the product and the acoustic performance of the micro speaker are ensured while the above design cooperates with the design of the upper housing 11.

The upper housing 11 of the present invention comprises a plastic holder 111 and a steel sheet 110 injection-molded in the plastic holder 111. As the metal has greater strength, the required strength is achieved in the case of thinner thickness. For example, the conventional plastic housing is required to have a thickness of 0.5 mm to achieve the required strength, while the steel sheet structure is only required to have a thickness of 0.2 mm to achieve the required strength, in the case of a certain outline dimension of the micro speaker, the internal space of the micro speaker can be increased to increase the size of the vibration system and the magnetic circuit system, thereby improving the acoustic performance of the product.

In addition, the present invention also comprises a middle housing 12 and a lower housing 13. During assembly, the entire magnetic circuit system and the middle housing 12 are assembled together, and then the combination of the middle housing 12 and the magnetic circuit system is assembled into the lower housing 13, which facilitates the accurate positioning of the magnetic circuit system and the lower housing 13, and ensures the accuracy of the assembly.

Preferably, in the present invention, the sound hole A is provided at the lateral side of the micro speaker, as shown in FIG. 1, and particularly the sound hole A is provided on the side wall of the upper housing 11. An opening penetrating through the inner side wall and the outer side wall of the upper housing 11 is formed on the upper housing 11 by removing material, so that the sound at the front side of the vibrating diaphragm 21 is radiated to the outside through the sound hole A. Preferably, the sound hole A formed by removing material on the upper housing 11 is a non-closed opening, and an acoustic radiation passage for the vibrating diaphragm 21 is formed by the sound hole A together with the middle housing 12. This structural design cooperates with the shorter side wall of the upper housing 11 to ensure the effective area of the sound hole A.

Figure 3:
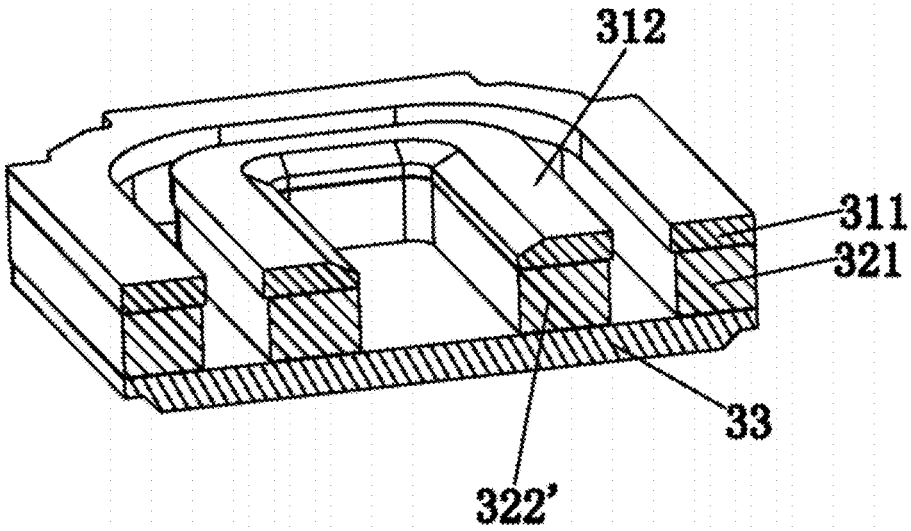
FIG. 3 is a cross sectional view of a magnetic circuit system according to the second embodiment of the present invention.
Figure 4:
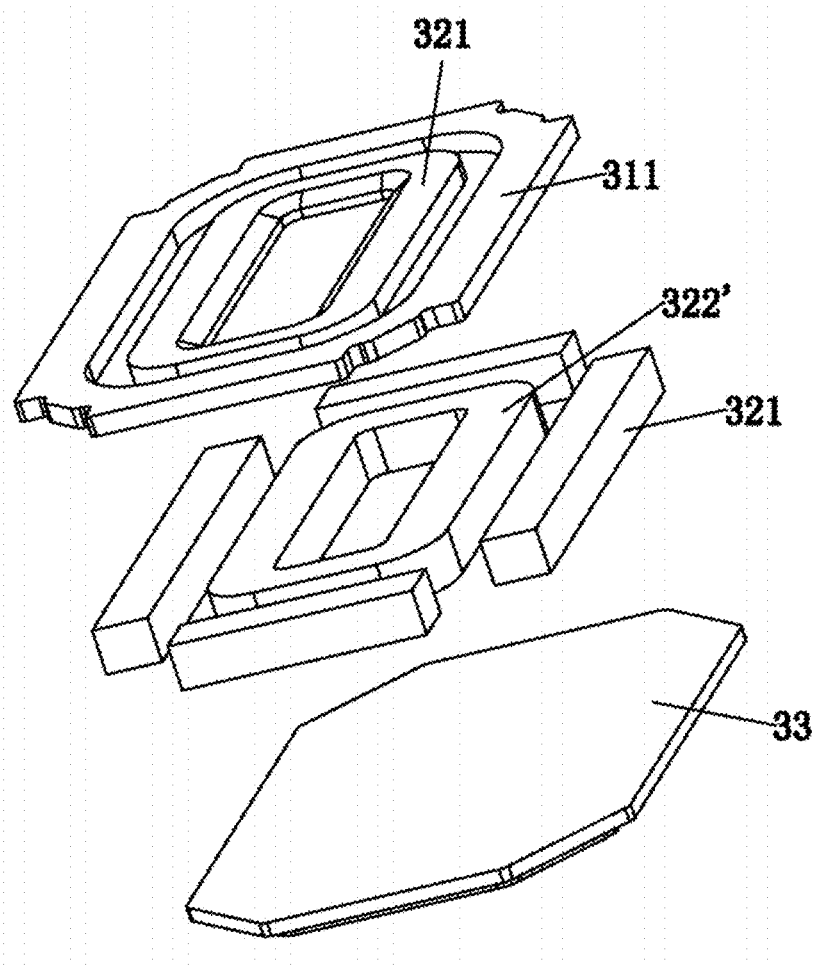
FIG. 4 is an exploded view of the magnetic circuit system according to the second embodiment of the present invention.

Second Embodiment:

As jointly shown in FIG. 3 and FIG. 4, the magnetic circuit system in the 'present embodiment is also a dual magnetic circuit structure and comprises a center magnet 322' and a center washer 312 at the central position of the magnetic yoke 33, as well as an edge magnet 321 and an edge washer 311 at the edge position of the magnetic yoke 33. The magnetic gap is formed between the center magnet 322' along with the center washer 312 and the edge magnet 321 along with the edge washer 311. The main difference between the present embodiment and the above-described embodiment is that the center magnet 322' is also a hollow annular structure, the area of the hollow area of the center washer 312 is the same as the area of the hollow area of the center magnet 322', and the orthographic projection area of the hollow area of the center washer 312 overlaps with the orthographic projection area of the hollow area of the center magnet 322' after assembly. This structure in the present embodiment is also applicable to the use of a micro speaker having a groove structure in the upper housing, when the groove structures of the upper housing and the vibrating diaphragm are deep, the center magnet 322' is also provided with a dodging structure, and the dodging structure may be a hollowed out structure.

With this structure, the design of providing corresponding dodging structures at the positions on the center washer 312 and the center magnet 322' opposite to the groove structure of the upper housing, respectively, the normal operation of the product and the acoustic performance of the micro speaker are ensured while the above design cooperates with the design of the upper housing.

In addition, the micro speaker according to the present invention is not limited to the above-described dual magnetic circuit structure, but may be a single magnetic circuit structure, that is, a structure only comprising the center washer, the center magnet and the magnetic yoke. A hollow annular structure for avoiding the groove structures of the upper housing and the vibrating diaphragm is provided at the position on the center washer opposite to the groove structure of the upper housing. Alternatively, each of the center washer and the center magnet of the micro speaker of the single magnetic circuit structure is a hollow annular structure for avoiding the groove structures of the upper housing and the vibrating diaphragm.

With the above teaching of the present invention, other improvements and variants, which fall into the scope of the present invention, can be made by those skilled in the art based on the above embodiments. It will be understood by those skilled in the art that the above specific description aims at better understanding of the present invention, and the scope of the present invention is limited by the claims and its equivalents.

The invention claimed is:

1. A micro speaker, comprising a vibration system, a magnetic circuit system and a support system for accommodating and fixing the vibration system and the magnetic circuit system, wherein the vibration system comprises a vibrating diaphragm and a voice coil bonded to one side of the vibrating diaphragm, and the vibrating diaphragm comprises a rigid dome portion located at a central position and a suspension ring portion located at an edge position; the magnetic circuit system comprises a washer, a magnet and a magnetic yoke which are sequentially combined together, and a magnetic gap for accommodating the voice coil is formed in the magnetic circuit system; the support system comprises an upper housing; and the upper housing is provided with a recessed groove structure at a position corresponding to the dome portion of the vibrating diaphragm, wherein the dome portion is provided with a dodging groove at a position opposite to the groove structure of the upper housing; a vertical depth of the dodging groove is not less than a depth of the groove structure of the upper housing; and an orthographic projection area of the dodging groove covers an orthographic projection area of the groove structure of the upper housing;

the washer is provided with a dodging structure opposite to the dodging groove of the vibrating diaphragm; a vertical depth of the dodging structure is not less than the depth of the dodging groove; and an orthographic projection area of the dodging structure covers the orthographic projection area of the dodging groove of the vibrating diaphragm.

2. The micro speaker according to claim 1, wherein a thickness of the washer is not less than the vertical depth of the dodging groove of the vibrating diaphragm;

the washer opposite to the vibrating diaphragm is a hollow annular structure, the dodging structure of the washer is a hollow portion of the washer, and an orthographic projection area of the hollow portion of the washer overlaps with the orthographic projection area of the dodging groove of the vibrating diaphragm.

3. The micro speaker according to claim 1, wherein the magnetic circuit system is a dual magnetic circuit structure that comprises a center washer and a center magnet which are bonded to a central position of the magnetic yoke, and an edge washer and an edge magnet which are bonded to an edge position of the magnetic yoke; wherein the center washer is provided at a position opposite to the dome portion of the vibrating diaphragm.

4. The micro speaker according to claim 3, wherein a thickness of the center washer is not less than the vertical depth of the dodging groove of the vibrating diaphragm;

the center washer is a hollow annular structure, and a hollow portion of the center washer is provided at a position opposite to the dodging groove of the vibrating diaphragm, and an orthographic projection area of the hollow portion of the washer overlaps with the orthographic projection area of the dodging groove of the vibrating diaphragm.

5. The micro speaker according to claim 3, wherein the center washer is a hollow annular structure, the center magnet is also a hollow annular structure, and an orthographic projection area of a hollow portion of the center magnet overlaps with an orthographic projection area of a hollow portion of the center washer.

6. The micro speaker according to claim 1, wherein the vertical depth of the dodging groove of the vibrating diaphragm is equal to the vertical depth of the groove structure of the upper housing.

7. The micro speaker according to claim 1, wherein each of the groove structure of the upper housing and the dodging groove of the vibrating diaphragm is provided with a transition slope, and the transition slope of the groove structure is parallel to the transition slope of the dodging groove.

8. The micro speaker according to claim 3, wherein each of the dodging groove of the vibrating diaphragm and an inner edge of the center washer is provided with a transition slope, and the transition slope of the dodging groove is parallel to the transition slope of the inner edge of the center washer.

9. The micro speaker according to claim 1, wherein the support system further comprises a middle housing and a lower housing, and the middle housing and the lower housing support and fix the magnetic circuit system.

10. The micro speaker according to claim 1, wherein the upper housing comprises a plastic holder and a steel sheet which is coupled with the plastic holder through injection molding;

a sound hole of the micro speaker is located at a lateral side of the micro speaker, and is provided on a side wall of the upper housing.

* * * * *